US008262195B2

(12) United States Patent
Maida et al.

(10) Patent No.: US 8,262,195 B2
(45) Date of Patent: Sep. 11, 2012

(54) RECORDING HEAD CLEANING APPARATUS, IMAGE RECORDING APPARATUS AND RECORDING HEAD CLEANING METHOD

(75) Inventors: Noriaki Maida, Kanagawa-ken (JP); Yasuyo Yokota, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 256 days.

(21) Appl. No.: 12/711,659

(22) Filed: Feb. 24, 2010

(65) Prior Publication Data

US 2010/0214356 A1 Aug. 26, 2010

(30) Foreign Application Priority Data

Feb. 25, 2009 (JP) ..... 2009-042990

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 6,281,909 | B1 | 8/2001 | Fassler et al. | |
| 6,592,201 | B2 | 7/2003 | Sharma et al. | |
| 2008/0122892 | A1 * | 5/2008 | Sakamoto | 347/33 |

FOREIGN PATENT DOCUMENTS

JP 2000-94703 A 4/2000

* cited by examiner

*Primary Examiner* — Matthew Luu
*Assistant Examiner* — Alejandro Valencia
(74) *Attorney, Agent, or Firm* — Birch, Stewart, Kolasch & Birch, LLP.

(57) ABSTRACT

The recording head cleaning apparatus cleans a nozzle surface of a recording head that is disposed at an inclination with respect to horizontal. The recording head cleaning apparatus includes: an application roller having a substantially conical shape of which a circumferential surface holds cleaning liquid and has an inclination corresponding to the inclination of the nozzle surface, an axis of the substantially conical shape being a rotational axis of the application roller; and a rotating device which rotates the application roller on the rotational axis to apply the cleaning liquid to the nozzle surface while not making the application roller in contact with the nozzle surface.

20 Claims, 9 Drawing Sheets

RELATED ART

RELATED ART

RECORDING HEAD CLEANING APPARATUS, IMAGE RECORDING APPARATUS AND RECORDING HEAD CLEANING METHOD

BACKGROUND OF THE INVENTION

1. Field of the Invention

The present invention relates to a recording head cleaning apparatus, an image recording apparatus and a recording head cleaning method, and more particularly to a recording head maintenance system in an image recording apparatus which employs a drum conveyance system to convey a recording medium.

2. Description of the Related Art

As a general image recording apparatus, it is suitable to use an inkjet recording apparatus, which forms a desired image on a recording medium by ejecting and depositing colored inks from a plurality of nozzles provided in an inkjet head. If the inkjet head is operated for a long period of time, adhering matter such as solidified ink or paper dust from the recording medium, and the like, adhere to the nozzle surface. In particular, if adhering matter becomes attached to the vicinity of the nozzles and the nozzle apertures, this gives rise to deflection of the ejection direction of the ink ejected from the nozzles, or reduction in the ejection volume, and so on, and therefore an inkjet recording apparatus is composed in such a manner that cleaning of the nozzle surface is carried out appropriately.

Japanese Patent Application Publication No. 2000-094703 discloses a cleaning apparatus which applies a cleaning liquid in a non-contact fashion to an inkjet head which is horizontally installed, by rotating an application roller having a cylindrical shape which is immersed in the cleaning liquid. However, the nozzle surface of an inkjet head that records an image on a recording sheet held on the outer circumferential surface of a cylindrical conveyance roller has a prescribed inclination with respect to the horizontal, in order to maintain a uniform distance with respect to the recording sheet. When carrying out cleaning of the inkjet head thus disposed in the inclined state, using an application roller having cleaning liquid held on the surface thereof, it is necessary to incline the application roller in such a manner that the application roller is parallel to the nozzle surface.

If an application roller 200 in a cleaning apparatus 202 shown in FIG. 8 is inclined in accordance with the inclination of a nozzle surface 204A of an inkjet head 204, then the state depicted in FIG. 9 is obtained. In the cleaning apparatus 202 depicted in FIG. 9, a liquid surface 212 of a cleaning liquid 210 accommodated in a case 208 is inclined with respect to a rotational axle 216 of the cleaning roller 200, and therefore it is almost impossible to create a coating layer (liquid pool) 214 of the cleaning liquid in an upper portion 200B of an inclined surface 200A of the application roller 200, and hence the coating layer 214 of the cleaning liquid assumes a non-uniform shape and collects in a lower portion 200C of the inclined surface 200A. In the coating layer 214 having an instable shape of this kind, it is difficult to achieve stable application of the cleaning liquid to the nozzle surface 204A of the inkjet head 204.

SUMMARY OF THE INVENTION

The present invention has been contrived in view of these circumstances, an object thereof being to provide a head cleaning apparatus, an image recording apparatus and a head cleaning method, whereby cleaning liquid can be applied stably to a nozzle surface of an inkjet head having a prescribed inclination with respect to the horizontal.

In order to attain the aforementioned object, the present invention is directed to a recording head cleaning apparatus which cleans a nozzle surface of a recording head that is disposed at an inclination with respect to horizontal, the apparatus comprising: an application roller having a substantially conical shape of which a circumferential surface holds cleaning liquid and has an inclination corresponding to the inclination of the nozzle surface, a rotational axis of the application roller being an axis of the substantially conical shape; and a rotating device which rotates the application roller on the rotational axis to apply the cleaning liquid to the nozzle surface while not making the application roller in contact with the nozzle surface.

According to the present invention, when cleaning the nozzle surface of the recording head that is disposed at the inclination with respect to the horizontal, the substantially conical application roller having the circumferential surface with the inclination corresponding to the inclination of the nozzle surface with respect to the horizontal is used, and therefore the cleaning liquid assumes a uniform shape from the upper portion to the lower portion of the inclined circumferential surface of the application roller, and stable application of the cleaning liquid can be achieved from the upper portion to the lower portion of the inclined nozzle surface.

DETAILED DESCRIPTION OF THE PREFERRED EMBODIMENTS

Entire Configuration of Inkjet Recording Apparatus

First, an inkjet recording apparatus will be described as an embodiment of an image forming apparatus according to the present invention.

Figure 1:
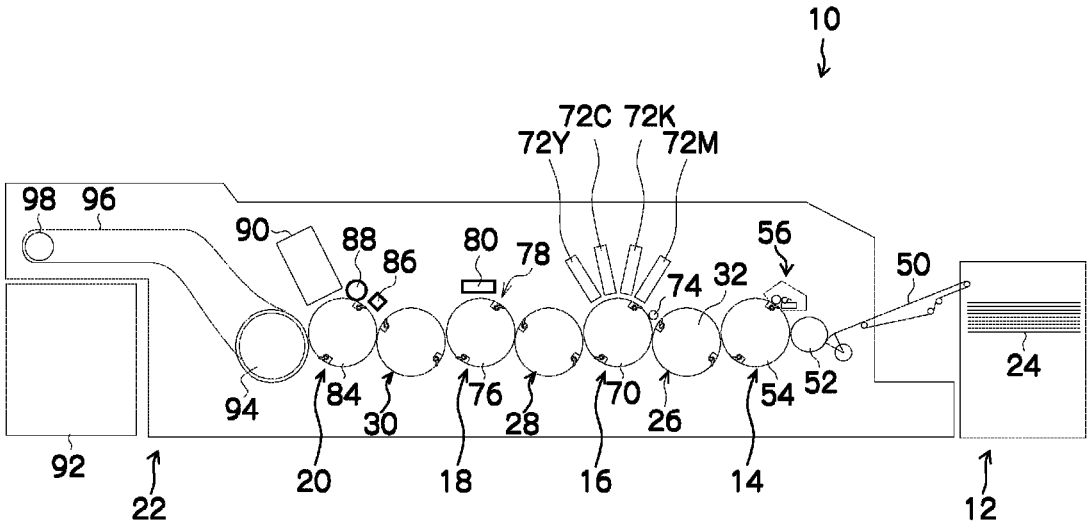
FIG. 1 is a general schematic drawing of an inkjet image recording apparatus according to an embodiment of the present invention.

FIG. 1 is a structural diagram illustrating the entire configuration of an inkjet recording apparatus 10 according to an embodiment of the present invention. The inkjet recording apparatus 10 shown in the drawing is an recording apparatus in a two-liquid aggregating system of forming an image on a recording surface of a recording medium 24 by using ink (an aqueous ink) and a treatment liquid (aggregation treatment liquid). The inkjet recording apparatus 10 includes a paper feed unit 12, a treatment liquid application unit 14, an image formation unit 16, a drying unit 18, a fixing unit 20, and a discharge unit 22 as the main components. A recording medium 24 (paper sheets) is stacked in the paper feed unit 12, and the recording medium 24 is fed from the paper feed unit 12 to the treatment liquid application unit 14. A treatment liquid is applied to the recording surface in the treatment liquid application unit 14, and then a color ink is applied to the recording surface in the image formation unit 16. The image is fixed with the fixing unit 20 on the recording medium 24 onto which the ink has been applied, and then the recording medium is discharged with the discharge unit 22.

In the inkjet recording apparatus 10, intermediate conveyance units 26, 28 and 30 are provided between the units, and the recording medium 24 is transferred by these intermediate conveyance units 26, 28 and 30. Thus, a first intermediate conveyance unit 26 is provided between the treatment liquid application unit 14 and image formation unit 16, and the to recording medium 24 is transferred from the treatment liquid application unit 14 to the image formation unit 16 by the first intermediate conveyance unit 26. Likewise, the second intermediate conveyance unit 28 is provided between the image formation unit 16 and the drying unit 18, and the recording medium 24 is transferred from the image formation unit 16 to the drying unit 18 by the second intermediate conveyance unit 28. Further, a third intermediate conveyance unit 30 is provided between the drying unit 18 and the fixing unit 20, and the recording medium 24 is transferred from the drying unit 18 to the fixing unit 20 by the third intermediate conveyance unit 30.

Each unit (paper feed unit 12, treatment liquid application unit 14, image formation unit 16, drying unit 18, fixing unit 20, discharge unit 22, and first to third intermediate conveyance units 26, 28 and 30) of the inkjet recording apparatus 10 will be described below in greater details.

<Paper Feed Unit>

The paper feed unit 12 feeds the recording medium 24 to the image formation unit 16. A paper feed tray 50 is provided in the paper feed unit 12, and the recording medium 24 is fed, sheet by sheet, from the paper feed tray 50 to the treatment liquid application unit 14.

<Treatment Liquid Application Unit>

The treatment liquid application unit 14 is a mechanism that applies a treatment liquid to the recording surface of the recording medium 24. The treatment liquid includes a coloring material aggregating agent that causes the aggregation of a coloring material (pigment) included in the ink applied in the image formation unit 16, and the separation of the coloring material and a solvent in the ink is enhanced when the treatment liquid is brought into contact with the ink.

As shown in FIG. 1, the treatment liquid application unit 14 includes a paper transfer drum 52, a treatment liquid drum 54, and a treatment liquid application device 56. The paper transfer drum 52 is disposed between the paper feed tray 50 of the paper feed unit 12 and the treatment liquid drum 54. The rotation of the paper transfer drum 52 is driven and controlled by a below-described motor driver 176 (see FIG. 7). The recording medium 24 fed from the paper feed unit 12 is received by the paper transfer drum 52 and transferred to the treatment liquid drum 54. The below-described intermediate conveyance unit may be also provided instead of the paper transfer drum 52.

The treatment liquid drum 54 is a drum that holds and rotationally conveys the to recording medium 24. The rotation of the treatment liquid drum 54 is driven and controlled by the below-described motor driver 176 (see FIG. 7). Further, the treatment liquid drum 54 is provided on the outer circumferential surface thereof with a hook-shaped holding device, by which the leading end of the recording medium 24 can be held. In a state in which the leading end of the recording medium 24 is held by the holding device, the treatment liquid drum 54 is rotated to rotationally convey the recording medium 24. In this case, the recording medium 24 is conveyed in a state where the recording surface thereof faces outward. The treatment liquid drum 54 may be provided with suction apertures on the outer circumferential surface thereof and connected to a suction device that performs suction from the suction apertures. As a result, the recording medium 24 can be held in a state of tight adherence to the outer circumferential surface of the treatment liquid drum 54.

The treatment liquid application device 56 is provided on the outside of the treatment liquid drum 54 opposite the outer circumferential surface thereof. The treatment liquid application device 56 applies the treatment liquid onto the recording surface of the recording medium 24. The treatment liquid application device 56 includes: a treatment liquid container, in which the treatment liquid to be applied is held; an anilox roller, a part of which is immersed in the treatment liquid held in the treatment liquid container; and a rubber roller, which is pressed against the anilox roller and the recording medium 24 that is held by the treatment liquid drum 54, so as to transfer the treatment liquid metered by the anilox roller 64 to the recording medium 24.

With the treatment liquid application device 56 of the above-described configuration, the treatment liquid is applied onto the recording medium 24, while being metered. In this case, it is preferred that the film thickness of the treatment liquid be sufficiently smaller than the diameter of ink droplets that are ejected from inkjet heads 72M, 72K, 72C and 72Y of the image formation unit 16. For example, when the ink droplet volume is 2 picoliters (pl), the average diameter of the droplet is 15.6 μm. In this case, when the film thickness of the treatment liquid is large, the ink dot will be suspended in the treatment liquid, without coming into contact with the surface of the recording medium 24. Accordingly, when the ink droplet volume is 2 pl, it is preferred that the film thickness of the treatment liquid be not more than 3 μm in order to obtain a landing dot diameter not less than 30 μm.

In the present embodiment, the application system using the roller is used to deposit the treatment liquid onto the recording surface of the recording medium 24; however, the to present invention is not limited to this, and it is possible to employ a spraying method, an inkjet method, or other methods of various types.

<Image Formation Unit>

The image formation unit 16 is a mechanism which prints an image corresponding to an input image by ejecting and depositing droplets of ink by an inkjet method, and the image formation unit 16 includes an image formation drum 70, a paper pressing roller 74 and the inkjet heads 72M, 72K, 72C and 72Y. The inkjet heads 72M, 72K, 72C and 72Y correspond to inks of four colors: magenta (M), black (K), cyan (C) and yellow (Y), and are disposed in the order of description from the upstream side in the rotation direction of the image formation drum 70.

The image formation drum 70 is a drum that holds the recording medium 24 on the outer circumferential surface thereof and rotationally conveys the recording medium 24. The rotation of the image formation drum 70 is driven and controlled by the below-described motor driver 176 (see FIG. 7).

Further, the image formation drum 70 is provided on the outer circumferential surface thereof with a hook-shaped holding device, by which the leading end of the recording medium 24 can be held. In a state in which the leading end of the recording medium 24 is held by the holding device, the image formation drum 70 is rotated to rotationally convey the recording medium 24. In this case, the recording medium 24 is conveyed in a state where the recording surface thereof faces outward, and inks are deposited on the recording surface by the inkjet heads 72M, 72K, 72C and 72Y.

The paper pressing roller 74 is a guide member for causing the recording medium 24 to tightly adhere to the outer circumferential surface of the image formation drum 70, and is arranged so as to face the outer circumferential surface of the image formation drum 70. More specifically, the paper pressing roller 74 is disposed to the downstream side of the position where transfer of the recording medium 24 is received, and to the upstream side from the inkjet heads 72M, 72K, 72C and 72Y, in terms of the direction of conveyance of the recording medium 24 (the direction of rotation of the image formation drum 70).

When the recording medium 24 that has been transferred onto the image formation drum 70 from the intermediate conveyance unit 26 is rotationally conveyed in a state where the leading end portion of the recording medium 24 is held by the holding device, the recording medium 24 is pressed by the paper pressing roller 74 to tightly adhere to the outer to circumferential surface of the image formation drum 70. When the recording medium 24 has been made to tightly adhere to the outer circumferential surface of the image formation drum 70 in this way, the recording medium 24 is conveyed to a print region directly below the inkjet heads 72M, 72K, 72C and 72Y in a state where the recording medium 24 does not float up at all from the outer circumferential surface of the image formation drum 70.

The inkjet heads 72M, 72K, 72C and 72Y are recording heads (inkjet heads) of the inkjet system of the full line type that have a length corresponding to the maximum width of the image formation region in the recording medium 24. A nozzle row is formed on the ink ejection surface of the inkjet head. The nozzle row has a plurality of nozzles arranged therein for discharging ink over the entire width of the image recording region. Each of the inkjet heads 72M, 72K, 72C and 72Y is fixedly disposed so as to extend in the direction perpendicular to the conveyance direction (rotation direction of the image formation drum 70) of the recording medium 24.

Furthermore, each of the inkjet heads 72M, 72K, 72C and 72Y is disposed at an inclination with respect to the horizontal, in such a manner that each of the nozzle surfaces of the inkjet heads 72M, 72K, 72C and 72Y is substantially parallel to the recording surface of the recording medium 24 held on the outer circumferential surface of the image formation drum 70.

Droplets of corresponding colored inks are ejected from the inkjet heads 72M, 72K, 72C and 72Y having the above-described configuration toward the recording surface of the recording medium 24 held on the outer circumferential surface of the image formation drum 70. As a result, the ink comes into contact with the treatment liquid that has been heretofore applied on the recording surface by the treatment liquid application unit 14, the coloring material (pigment) dispersed in the ink is aggregated, and a coloring material aggregate is formed. Therefore, the coloring material flow on the recording medium 24 is prevented and an image is formed on the recording surface of the recording medium 24. In this case, because the image formation drum 70 of the image formation unit 16 is structurally separated from the treatment liquid drum 54 of the treatment liquid application unit 14, the treatment liquid does not adhere to the inkjet heads 72M, 72K, 72C and 72Y, and the number of factors preventing the ejection of ink can be reduced.

In the present embodiment, the CMYK standard color (four colors) configuration is described, but combinations of ink colors and numbers of colors are not limited to that of the to present embodiment, and if necessary, light inks, dark inks, and special color inks may be added. For example, a configuration is possible in which inkjet heads are added that eject light inks such as light cyan and light magenta. The arrangement order of color heads is also not limited.

Although not shown in FIG. 1, a head cleaning unit 160 (see FIG. 5) which cleans the nozzle surfaces of the inkjet heads 72M, 72K, 72C and 72Y (a nozzle surface is denoted with reference numeral 72A in FIG. 5) is arranged in the vicinity of the image formation drum 70. The details of the head cleaning unit 160 are described hereinafter.

<Drying Unit>

The drying unit 18 dries water included in the solvent separated by the coloring material aggregation action. As shown in FIG. 1, the drying unit includes a drying drum 76 and a solvent dryer 78.

The drying drum 76 is a drum that holds the recording medium 24 on the outer circumferential surface thereof and rotationally conveys the recording medium 24. The rotation of the drying drum 76 is driven and controlled by the below-described motor driver 176 (see FIG. 7). Further, the drying drum 76 is provided on the outer circumferential surface thereof with a hook-shaped holding device, by which the leading end of the recording medium 24 can be held. In a state in which the leading end of the recording medium 24 is held by the holding device, the drying drum 76 is rotated to rotationally convey the recording medium. In this case, the recording medium 24 is conveyed in a state where the recording surface thereof faces outward. The drying treatment is carried out by the solvent dryer 78 with respect to the recording surface of the recording medium 24. The drying drum 76 may be provided with suction apertures on the outer circumferential surface thereof and connected to a suction device that performs suction from the suction apertures. As a result, the recording medium 24 can be held in a state of tight adherence to the outer circumferential surface of the drying drum 76.

The solvent dryer 78 is disposed in a position facing the outer circumferential surface of the drying drum 76, and includes a halogen heater 80. The halogen heater 80 is controlled to blow warm air at a prescribed temperature (for example, 50° C. to 70° C.) at a constant blowing rate (for example, 12 $m^3$/min) toward the recording medium 24.

With the solvent dryer 78 of the above-described configuration, water included in the ink solvent on the recording surface of the recording medium 24 held by the drying drum 76 is to evaporated, and drying treatment is performed. In this case, because the drying drum 76 of the drying unit 18 is structurally separated from the image formation drum 70 of the image formation unit 16, the number of ink non-ejection events caused by drying of the head meniscus portion by thermal drying can be reduced in the inkjet heads 72M, 72K, 72C and 72Y. Further, there is a degree of freedom in setting the temperature of the drying unit 18, and the optimum drying temperature can be set.

It is desirable that the curvature of the drying drum 76 is in the range of not less than 0.002 (1/mm) and not more than 0.0033 (1/mm). If the curvature of the drying drum 76 is less than 0.002 (1/mm), then even if the recording medium 24 is made to curve, an insufficient effect in correcting cockling of the recording medium 24 is obtained, and if the curvature exceeds 0.0033 (1/mm), then the recording medium 24 is curved more than necessary and does not return to its original shape, but rather is output to the stack in a curved state.

Furthermore, it is desirable that the surface temperature of the drying drum 76 is set to 50° C. or above. By heating from the rear surface of the recording medium 24, drying is promoted and breaking of the image during fixing can be prevented. In this case, more beneficial effects are obtained if a device for causing the recording medium 24 to tightly adhere to the outer circumferential surface of the drying drum 76 is provided. As a device for causing the recording medium 24 to tightly adhere in this way, it is possible to employ various methods, such as vacuum suction, electrostatic attraction, or the like.

There are no particular restrictions on the upper limit of the surface temperature of the drying drum 76, but from the viewpoint of the safety of maintenance operations such as cleaning the ink adhering to the surface of the drying drum 76 (namely, preventing burns due to high temperature), desirably, the surface temperature of the drying drum 76 is not higher than 75° C. (and more desirably, not higher than 60° C.).

By holding the recording medium 24 in such a manner that the recording surface thereof is facing outward on the outer circumferential surface of the drying drum 76 having this composition (in other words, in a state where the recording surface of the recording medium 24 is curved in a convex shape), and drying while conveying the recording medium in rotation, it is possible to prevent the occurrence of wrinkles or floating up of the recording medium 24, and therefore drying non-uniformities caused by these phenomena can be prevented reliably.

<Fixing Unit>

The fixing unit 20 includes a fixing drum 84, a halogen heater 86, a fixing roller 88, and an inline sensor 90. The halogen heater 86, the fixing roller 88, and the inline sensor 90 are arranged in positions opposite the outer circumferential surface of the fixing drum 84 in this order from the upstream side in the rotation direction (counterclockwise direction in FIG. 1) of the fixing drum 84.

The fixing drum 84 a drum that holds the recording medium 24 on the outer circumferential surface thereof and rotationally conveys the recording medium 24. The rotation of the fixing drum 84 is driven and controlled by the below-described motor driver 176 (see FIG. 7). The fixing drum 84 has a hook-shaped holding device, and the leading end of the recording medium 24 can be held by this holding device. The recording medium 24 is rotationally conveyed by rotating the fixing drum 84 in a state in which the leading end of the recording medium 24 is held by the holding device. In this case, the recording medium 24 is conveyed in a state where the recording surface thereof faces outward, and the preheating by the halogen heater 86, the fixing treatment by the fixing roller 88 and the inspection by the inline sensor 90 are performed with respect to the recording surface. The fixing drum 84 may be provided with suction apertures on the outer circumferential surface thereof and connected to a suction device that performs suction from the suction apertures. As a result, the recording medium 24 can be held in a state of tight adherence to the outer circumferential surface of the fixing drum 84.

The halogen heater 86 is controlled to a prescribed temperature (for example, 180° C.), by which the preheating is performed with respect to the recording medium 24.

The fixing roller 88 is a roller member which applies heat and pressure to the dried ink to melt and fix the self-dispersible polymer particles in the ink so as to transform the ink into the film. More specifically, the fixing roller 88 is arranged so as to be pressed against the fixing drum 84, and a nip roller is configured between the fixing roller 88 and the fixing drum 84. As a result, the recording medium 24 is squeezed between the fixing roller 88 and the fixing drum 84, nipped under a prescribed nip pressure (for example, 0.15 MPa), and subjected to fixing treatment.

Further, the fixing roller 88 is configured by a heating roller in which a halogen lamp is incorporated in a metal pipe, for example made from aluminum, having good thermal conductivity and the rollers are controlled to a prescribed temperature (for example 60° C. to 80° C.). Where the recording medium 24 is heated with the heating roller, thermal energy not lower than a Tg temperature (glass transition temperature) of a latex included in the ink is applied and latex particles are melted. As a result, fixing is performed by penetration into the projections-recessions of the recording medium 24, the projections-recessions of the image surface are leveled out, and gloss is obtained.

The fixing unit 20 is provided with the single fixing roller 88 in the above-described embodiment; however, it is possible that a plurality of fixing rollers 88 depending on the thickness of image layer and Tg characteristic of latex particles. Furthermore, the surface of the fixing drum 84 may be controlled to a prescribed temperature (for example 60° C.).

On the other hand, the inline sensor 90 is a measuring device which measures the check pattern, moisture amount, surface temperature, gloss, and the like of the image fixed to the recording medium 24. A CCD sensor or the like can be used for the inline sensor 90.

With the fixing unit 20 of the above-described configuration, the latex particles located within a thin image layer formed in the drying unit 18 are melted by application of heat and pressure by the fixing roller 88. Thus, the latex particles can be reliably fixed to the recording medium 24. In addition, with the fixing unit 20, the fixing drum 84 is structurally separated from other drums. Therefore, the temperature of the fixing unit 20 can be freely set separately from the image formation unit 16 and the drying unit 18.

In particular, similarly to the drying drum 76 described above, the fixing drum 84 used in the present embodiment is constituted of a rotating conveyance body having a prescribed curvature and a surface temperature set to a prescribed temperature, and desirably, the curvature of the fixing drum 84 is in a range of not less than 0.002 (1/mm) and not more than 0.0033 (1/mm) or lower. If the curvature of the fixing drum 84 is less than 0.002 (1/mm), then even if the recording medium 24 is made to curve, an insufficient effect in correcting cockling of the medium is obtained, and if the curvature exceeds 0.0033 (1/mm), then the recording medium 24 is curved more than necessary and does not return to its original shape, but rather is output to the stack in a curved state.

It is desirable that the surface temperature of the fixing drum 84 is set to 50° C. or above. Drying is promoted by heating the recording medium 24 held on the outer circumferential surface of the fixing drum 84 from the rear surface, and therefore breaking of the image during fixing can be prevented, and furthermore, the strength of the image can be increased by the effects of the increased temperature of the image.

There are no particular restrictions on the upper limit of the surface temperature of to the fixing drum 84, but desirably, it is set to 75° C. or lower (and more desirably, 60° C. or lower), from the viewpoint of maintenance characteristics.

Moreover, it is desirable that the fixing roller 88 used in the present embodiment has a surface hardness of not higher than 71°. By making the surface of the fixing roller 88, which is a heating and pressing member, softer, it is possible to expect a beneficial effect in the fixing roller following the indentations which occur in the recording medium 24 as a result of cockling, then it is possible to prevent the occurrence of fixing non-uniformities.

Furthermore, it is desirable to achieve a state where the moisture in the image has been evaporated off and the high-boiling-point organic solvent has been concentrated to a suitable concentration in the image (in other words, a state where the high-boiling-point organic solvent in the image remains at a rate of 4% or more of the ink droplet ejection volume), since the image deforms more readily with respect to the surface of the fixing roller (heating and pressing member) 88 during fixing, while having sufficient strength to avoid breaking of the image. Moreover, if a binder component is contained in the image, then it is desirable to preheat the image, so that the image can be expected to similarly follow the surface of the fixing roller 88, and fixing non-uniformities can be prevented yet more effectively.

Here, the "state where the high-boiling-point organic solvent in the image remains at a rate of 4% or more of the ink droplet ejection volume" means that the ratio of the remaining amount of high-boiling-point organic solvent in the image present on the surface of the recording medium with respect to the ink droplet ejection volume at the time of the fixing process is 4% or above.

By holding the recording medium 24 with the recording surface thereof facing outward on the outer circumferential surface of the fixing drum 84 having this composition (in other words, in a state where the recording surface of the recording medium 24 is curved in a convex shape), and heating and pressing to fix the image while conveying the recording medium in rotation, then even in a state where the moisture is not completely dried off and some degree of cockling is liable to occur, this cockling can be rectified.

Furthermore, since fixing can be carried out by the fixing roller 88 in a state where the surface of the recording medium 24 is pulled and stretched against the force that seeks to create indentations in the surface (recording surface) of the recording medium 24 due to the swelling of the pulp fibers, and hence the indentations caused by cockling have been alleviated to and flattened, then it is possible to prevent the occurrence of fixing non-uniformities caused by cockling.

<Discharge Unit>

As shown in FIG. 1, the discharge unit 22 is provided after the fixing unit 20. The discharge unit 22 includes a discharge tray 92, and a transfer body 94, a conveying belt 96, and a tension roller 98 are provided between the discharge tray 92 and the fixing drum 84 of the fixing unit 20 so as to face the discharge tray 92 and the fixing drum 84. The recording medium 24 is fed by the transfer body 94 onto the conveying belt 96 and discharged onto the discharge tray 92.

<Intermediate Conveyance Unit>

The structure of the first intermediate conveyance unit 26 will be described below.

The second intermediate conveyance unit 28 and the third intermediate conveyance unit 30 are configured identically to the first intermediate conveyance unit 26 and the explanation thereof will be omitted.

The first intermediate conveyance unit 26 is provided with an intermediate conveyance body 32, which is a drum for receiving the recording medium 24 from a drum of a previous stage, rotationally conveying the recording medium 24, and transferring it to a drum of the subsequent stage, and is mounted to be capable of rotating freely. The intermediate conveyance body 32 is rotated by a motor 188 (not shown in FIG. 1 and shown in FIG. 7), and the rotation thereof is driven and controlled by the below-described motor driver 176 (see FIG. 7). Further, the intermediate conveyance body 32 is provided on the outer circumferential surface thereof with a hook-shaped holding device, by which the leading end of the recording medium 24 can be held. In a state in which the leading end of the recording medium 24 is held by the holding device, the intermediate conveyance body 32 is rotated to rotationally convey the recording medium 24. In this case, the recording medium 24 is conveyed in a state where the recording surface thereof faces inward, whereas the non-recording surface thereof faces outward.

The recording medium 24 conveyed by the first intermediate conveyance unit 26 is transferred to a drum of the subsequent stage (that is, the image formation drum 70). In this case, the transfer of the recording medium 24 is performed by synchronizing the holding device of the intermediate conveyance unit 26 and the holding device (the gripper 102) of the image formation unit 16. The transferred recording medium 24 is held by the image to formation drum 70 and rotationally conveyed.

<Structure of Ink Heads>

Next, the structure of the inkjet heads is described. The inkjet heads 72M, 72K, 72C and 72Y for the respective colored inks have the same structure, and a reference numeral 150 is hereinafter designated to any of the inkjet heads (hereinafter also referred to simply as the heads).

Figure 2A:
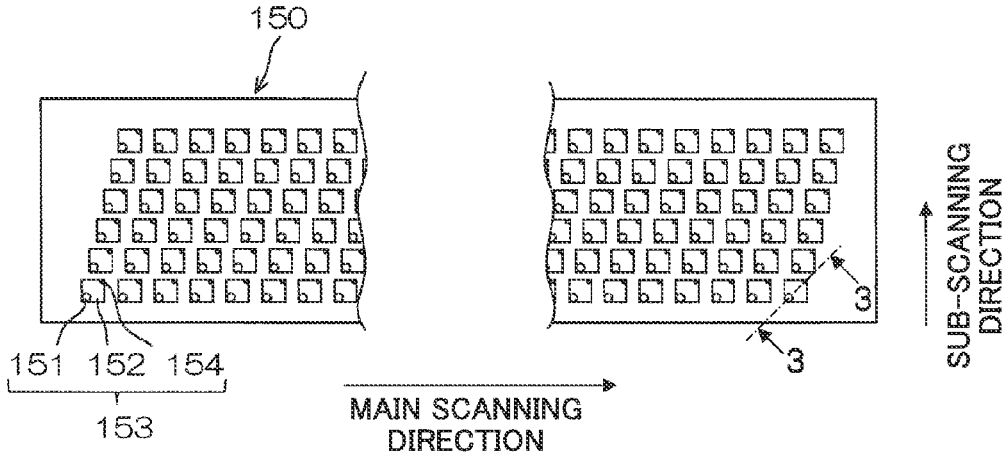
FIGS. 2A to 2C are plan view perspective diagrams showing embodiments of the inkjet head in FIG. 1.
Figure 2B:
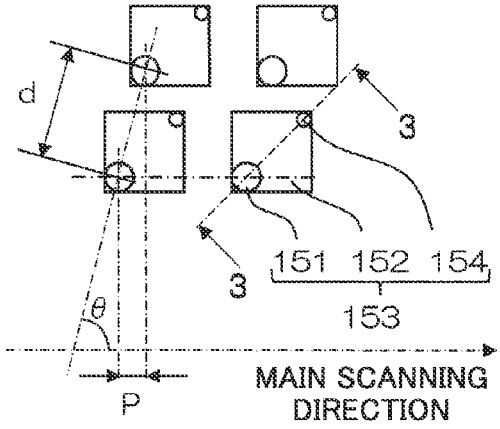
Figure 2C:
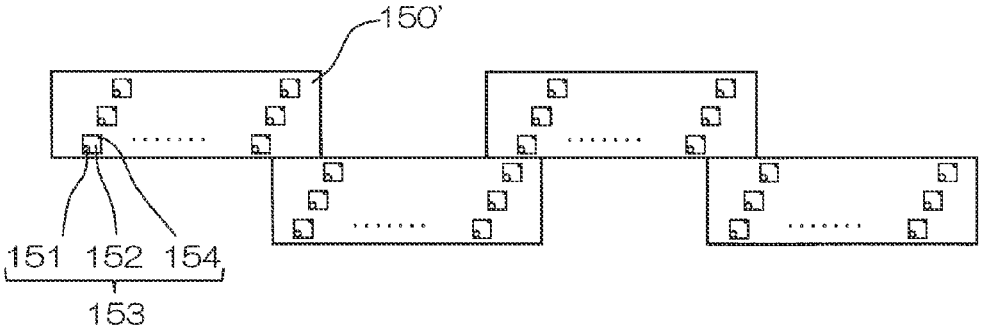
Figure 3:
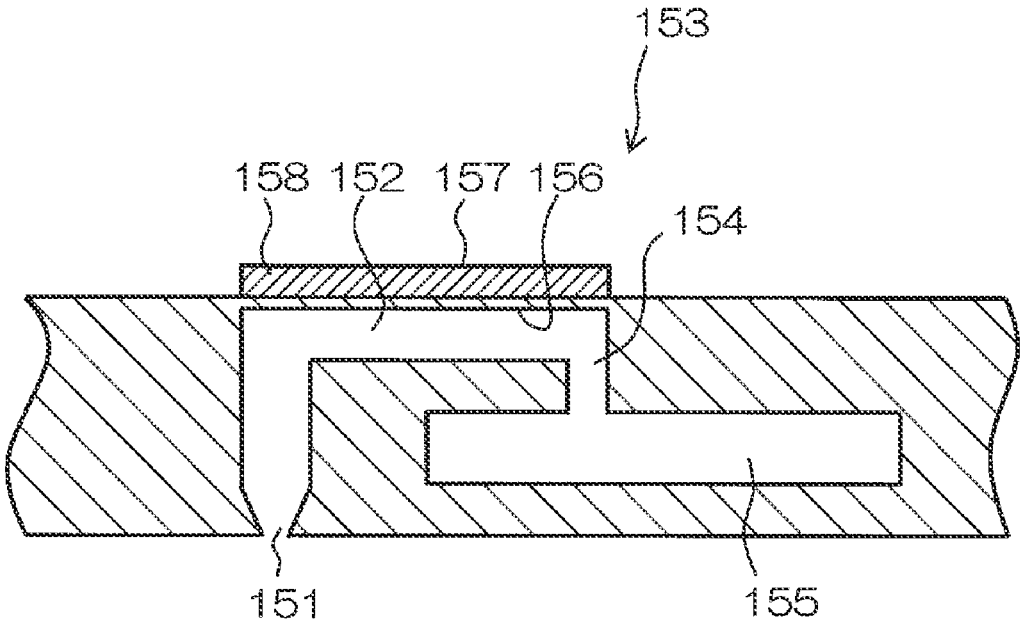
FIG. 3 is a cross-sectional diagram showing the inner composition of an ink chamber unit.

FIG. 2A is a perspective plan view showing an embodiment of the configuration of the head 150, FIG. 2B is an enlarged view of a portion thereof, and FIG. 2C is a perspective plan view showing another embodiment of the configuration of the head 150. FIG. 3 is a cross-sectional view taken along the line 3-3 in FIGS. 2A and 2B, showing the inner structure of an ink chamber unit in the head 150.

The nozzle pitch in the head 150 should be minimized in order to maximize the density of the dots printed on the surface of the recording medium 24. As shown in FIGS. 2A and 2B, the head 150 according to the present embodiment has a structure in which a plurality of ink chamber units (i.e., droplet ejection units serving as recording units) 153, each having a nozzle 151 forming an ink ejection aperture, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head 150 (the main scanning direction: the direction perpendicular to the conveyance direction of the recording medium 24) is reduced and high nozzle density is achieved.

The mode of forming one or more nozzle rows through a length corresponding to the entire width of the recording medium 24 in the main scanning direction substantially perpendicular to the conveyance direction of the recording medium 24 (the sub-scanning direction) is not limited to the embodiment described above. For example, instead of the configuration in FIG. 2A, as shown in FIG. 2C, a line head having nozzle rows of a length corresponding to the entire width of the recording medium 24 can be formed by arranging and combining, in a staggered matrix, short head blocks 150' having a plurality of nozzles 151 arrayed in a two-dimensional fashion. Furthermore, although not shown in the drawings, it is also possible to compose a line head by arranging short heads in one row.

The planar shape of the pressure chamber 152 provided for each nozzle 151 is substantially a square, and the nozzle 151 and an ink supply port 154 are disposed in both to corners on a diagonal line of the square. The shape of the pressure chamber 152 is not limited to that of the present embodiment, and a variety of planar shapes, for example, a polygon such as a rectangle (rhomb, rectangle, etc.), a pentagon and a heptagon, a circle, and an ellipse can be employed.

Each pressure chamber 152 is connected to a common channel 155 through the supply port 154. The common channel 155 is connected to an ink tank (not shown), which is a base tank for supplying ink, and the ink supplied from the ink tank is delivered through the common flow channel 155 to the pressure chambers 152.

A piezoelectric element 158 provided with an individual electrode 157 is bonded to a diaphragm 156, which forms a face (the upper face in FIG. 3) of the pressure chamber 152 and also serves as a common electrode. When a drive voltage is applied to the individual electrode 157, the piezoelectric element 158 is deformed, the volume of the pressure chamber 152 is thereby changed, and the ink is ejected from the nozzle 151 by the variation in pressure that follows the variation in volume. When the piezoelectric element 158 returns to the original state after the ink has been ejected, the pressure chamber 152 is refilled with new ink from the common channel 155 through the supply port 154.

The present embodiment applies the piezoelectric elements 158 as ejection power generation devices to eject the ink from the nozzles 151 arranged in the head 150; however, instead, a thermal system that has heaters within the pressure chambers 152 to eject the ink using the pressure resulting from film boiling by the heat of the heaters can be applied.

As shown in FIG. 2B, the high-density nozzle head according to the present embodiment is achieved by arranging the plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the ink chamber units 153 are arranged at a uniform pitch d in line with a direction forming the angle of θ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main to scanning direction has a high nozzle density of up to 2,400 nozzles per inch.

When implementing the present invention, the arrangement structure of the nozzles is not limited to the embodiments shown in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium 24 is moved in the breadthways direction (main scanning direction) of the recording medium 24, thereby performing printing in the breadthways direction, and when one printing action in the breadthways direction has been completed, the recording medium 24 is moved through a prescribed amount in the sub-scanning direction perpendicular to the breadthways direction, printing in the breadthways direction of the recording medium 24 is carried out in the next printing region, and by repeating this sequence, printing is performed over the whole surface of the printing region of the recording medium 24.

Description of Maintenance Unit

Figure 4:
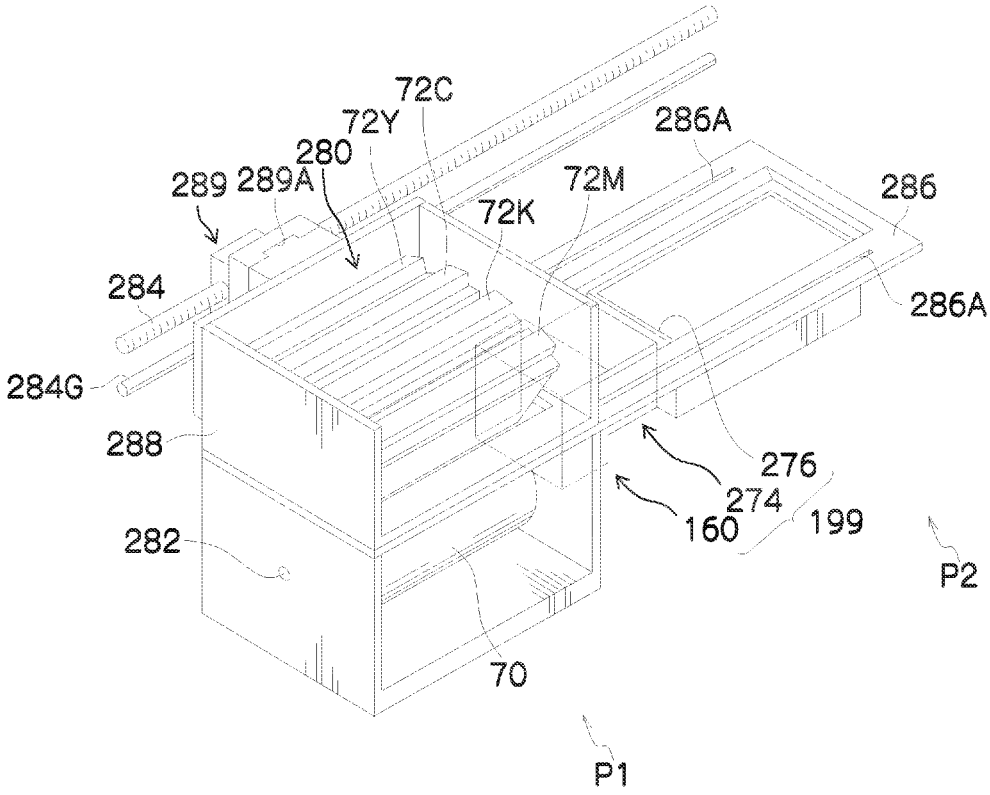
FIG. 4 is a general schematic drawing of a head maintenance unit according to an embodiment of the present invention.

FIG. 4 is a perspective diagram of a head maintenance unit 199 arranged adjacently to the print unit 16. As shown in FIG. 4, the head maintenance unit 199 for carrying out maintenance processing of the inkjet heads 72M, 72K, 72C and 72Y is arranged on the outside of the image formation drum 70 of the print unit 16, adjacently to the image formation drum 70 in the axial direction of the image formation drum 70.

The head maintenance unit 199 is provided with the head cleaning unit 160, a wiping unit 274 and a nozzle cap 276 disposed in this order from the side near the image formation drum 70.

A head unit 280 mounted with ink droplet ejection heads 72M, 72K, 72C and 72Y corresponding to the respective colors is engaged to a ball screw 284, which is disposed in parallel with the rotational axle 282 of the image formation drum 70. A guide shaft 284G is disposed in parallel with the ball screw 284, on the lower side of the ball screw 284, and the head unit 280 engages slidably with this guide shaft 284G. A guide rail member 286 having guide grooves 286A, which guide the movement of the head unit 280, is disposed in parallel with the ball screw 284, on the lower side of the head unit 280.

The head unit 280 has a frame body 288, which integrally holds the inkjet heads 72M, to 72K, 72C and 72Y. Engaging parts (not shown) are projectingly formed on the lower surface of the frame body 288, and slidably engage with the guide grooves 286A, whereby the head unit 280 is able to move by being guided by the guide grooves 286A.

As shown in FIG. 4, the ball screw 284, the guide shaft 284G and the guide rail member 286 are arranged extending in the axial direction of the image formation drum 70 through a prescribed length, in such a manner that the head unit 280 can be moved from an image forming position P1 above the image formation drum 70 to a maintenance position P2 facing the nozzle cap 276.

The ball screw 284 is rotated by a drive device such as a motor (not shown), and due to this rotation, the head unit 280 is moved between the image forming position P1 and the maintenance position P2. Furthermore, the head unit 280 can be moved in a direction away from the image formation drum 70 or in a direction toward the image formation drum 70, by means of an upward/downward movement mechanism (not shown).

The height of the head unit 280 with respect to the surface of the image formation drum 70 (namely, the clearance between the recording surface of the recording medium 24 and the respective inkjet heads 72M, 72K, 72C and 72Y) is controlled in accordance with the thickness of the recording medium 24 used. Furthermore, if a jam, or the like, occurs during conveyance of the recording medium, then the head unit 280 can be moved upward in FIG. 4 and thereby withdrawn from the prescribed height position during image formation.

As shown in FIG. 4, a coupling portion 289 between the frame body 288 of the head unit 280 and the ball screw 284 and the guide shaft 284G employs a linearly movable engagement structure 289A, which guides the upward and downward movement of the head unit 280.

<Head Cleaning Unit>

Next, the head cleaning unit 160 shown in FIG. 4 is described in detail.

Figure 5:
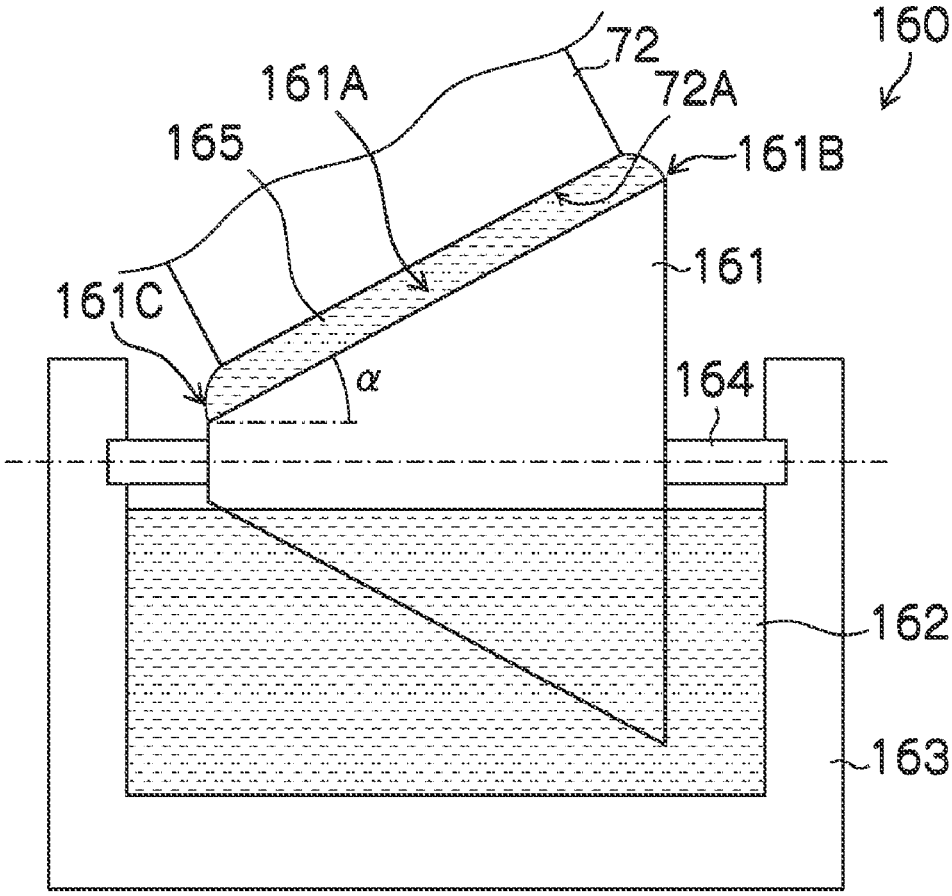
FIG. 5 is a general schematic drawing of a head cleaning unit according to an embodiment of the present invention.

FIG. 5 is a general schematic drawing of the head cleaning unit 160, viewed from the breadthways direction of a full line type of inkjet head 72, and the direction perpendicular to the sheet of the drawing is the lengthwise direction of the inkjet head 72 (the breadthways direction of the recording medium, which is perpendicular to the recording medium conveyance direction).

The head cleaning unit 160 shown in FIG. 5 includes an application roller 161, which applies cleaning liquid to the nozzle surface 72A of the inkjet head 72, and a case 163, which to accommodates the cleaning liquid 162. The application roller 161 has a conical shape in which the projected shape of the side face is a trapezoid, and the outer circumferential surface (generator) 161A has an inclination forming an angle of $\alpha$ with respect to the horizontal (which is indicated by the single-dotted line). The angle (inclination of the outer circumferential surface 161A) a formed between the outer circumferential surface 161A and the horizontal shown in FIG. 5 is 24°, and is substantially the same as the inclination of the nozzle surface 72A with respect to the horizontal.

The inclination of the outer circumferential surface 161A of the application roller 161 with respect to the horizontal can be changed appropriately in accordance with the shape and structure of the image formation drum 70 (see FIG. 1) and the composition and arrangement of the inkjet head 72. For example, if the inclination of the nozzle surface 72A with respect to the horizontal is 8°, then desirably, the inclination of the outer circumferential surface 161A of the application roller 161 with respect to the horizontal is also 8°.

When the inkjet head 72 is moved in the lengthwise direction in a state where the application roller 161 of the head cleaning unit 160 shown in FIG. 5 is positioned directly below the nozzle surface 72A while rotating the application roller 161, then the cleaning liquid is applied over the whole length of the lengthwise direction of the nozzle surface 72A. The direction of rotation of the application roller 161 may be the direction following the movement of the inkjet head 72 with respect to the application roller 161, or may be the direction opposite to this following direction.

The application roller 161 shown in FIG. 5 has a dimension in the breadthways direction (the conveyance direction of the recording medium), corresponding to the width of the inkjet head 72. In other words, the generator of the application roller 161 has the same length as the width of the inkjet head 72 or a greater length than the width of the inkjet head 72, and therefore it is possible to apply the cleaning liquid over the whole of the nozzle surface 72A by relatively moving the inkjet head 72 and the application roller 161 just once in the lengthwise direction of the inkjet head 72.

Moreover, the application roller 161 is composed so as to apply the cleaning liquid in a non-contact fashion, without touching the nozzle surface 72A. More specifically, the application roller 161 is supported by a rotational axle 164 parallel to the horizontal in such a manner that the substantially lower half of the application roller 161 is immersed in the cleaning liquid 162 inside the case 163 (to a level whereby the bearings supporting the to rotational axle 164 in the case 163 do not make contact with the cleaning liquid). In other words, the application roller 161 is immersed in the cleaning liquid 162 in such a manner that the dimension in the horizontal direction of the nozzle surface 72A and the dimension in the horizontal direction of the portion of the application roller 161 which portion is immersed in the cleaning liquid 162 are substantially the same.

When the thus supported application roller 161 is rotated about the rotational axle 164, the cleaning liquid 162 in the case 163 is taken up due to the surface tension on the outer circumferential surface 161A and a coating layer 165 of the cleaning liquid is formed on the outer circumferential surface 161A of the application roller 161. By making the coating layer 165 formed on the outer circumferential surface 161A of the application roller 161 come into contact with the nozzle surface 72A, the cleaning liquid is applied to the nozzle surface 72A.

When the application roller 161 having the shape shown in FIG. 5 is rotated about the rotational axle 164, since the moving speed is greater at the upper portion 161B of the inclined surface 161A than at the lower portion 161C, it is able to take up a greater amount of the cleaning liquid with the upper portion 161B than with the lower portion 161C. Consequently, since the coating layer 165 in the upper portion 161B of the inclined surface 161A is thicker than in the lower portion 161C, and since an action is also produced whereby the cleaning liquid accumulated in the lower portion 161C of the inclined roller surface 161A wets and spreads toward the upper portion 161B of the inclined surface 161A where the centrifugal force is greater, then the coating layer 165 wets and spreads uniformly over the outer circumferential surface 161A and it is possible to apply the cleaning liquid uniformly to the nozzle surface 72A, which is inclined with respect to the horizontal.

The outer circumferential surface 161A of the application roller 161 employs a material that is able to form the coating layer 165 of the cleaning liquid. For example, it is possible to employ a resin material, such as polytetrafluoroethylene, polyvinyl chloride, polyacetal (POM), or the like, an elastic material, such as ethylene propylene diene rubber (EPDM), silicone rubber, urethane rubber, or the like, a metal material, such as aluminum, stainless steel, titanium, or the like, or glass, etc.

The liquid employed for the cleaning liquid is a special liquid having a high cleaning effect, which has properties for dissolving solidified ink adhering to the nozzle surface 72A, and properties for forming the coating layer 165 on the outer circumferential surface 161A of the application roller 161. For example, it is possible to employ a cleaning liquid which to includes a solvent, such as DEGmBE (diethylene glycol monobutyl ether).

Figure 6:
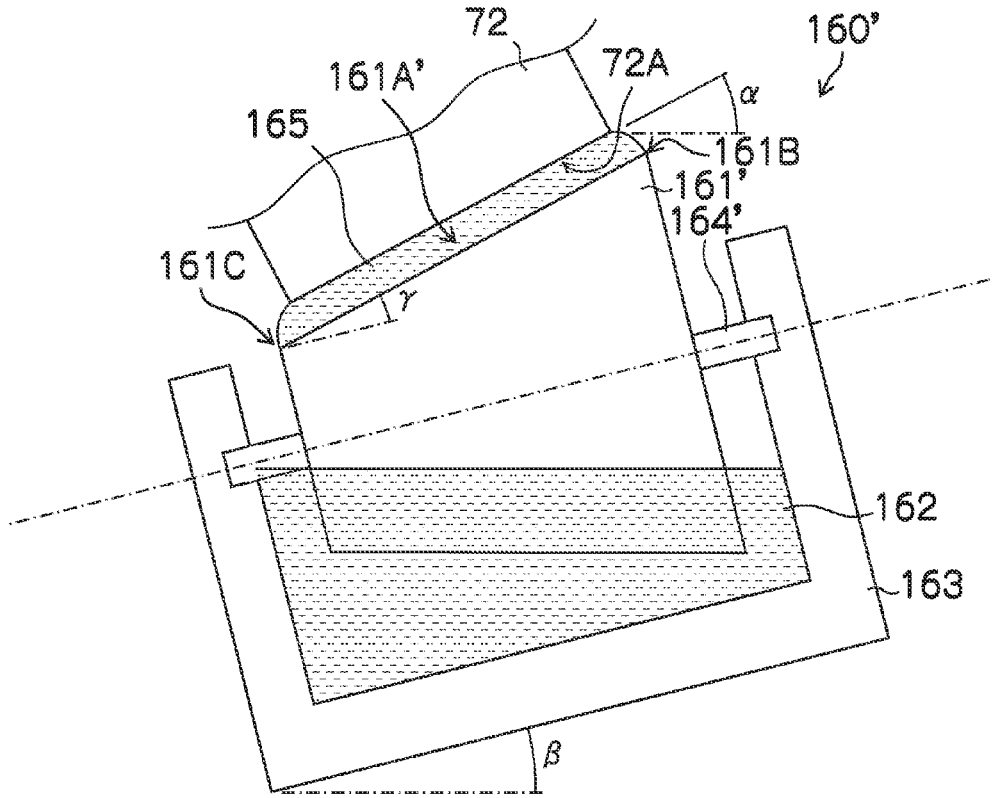
FIG. 6 is a diagram showing one mode of the head cleaning unit in FIG. 5.

It is also desirable that, as shown in FIG. 6, a rotational axle 164' of an application roller 161' in a head cleaning unit 160' is inclined with respect to the horizontal. In other words, the head cleaning unit 160' shown in FIG. 6 is composed in such a manner that the angle ($\beta+\gamma$) obtained by adding together the inclination angle $\beta$ of the rotational axle 164' of the application roller 161' with respect to the horizontal and the inclination angle $\gamma$ of the outer circumferential surface 161A' of the application roller 161' with respect to the rotational axle 164' is substantially the same as the inclination $\alpha$ (see also FIG. 5) of the nozzle surface 72A with respect to the horizontal (i.e., $\alpha \approx +\gamma$). In the case of the head cleaning unit 160' shown in FIG. 6, $\beta=12°$ and $\gamma=12°$ (and $\alpha=24°$). Of course, it is also possible to change $\beta$ and $\gamma$ appropriately, for instance, $\beta=4°$ and $\gamma=4°$ (when $\alpha=8°$), or to adopt a mode in which $\beta$ and $\gamma$ are different to each other.

In the head cleaning unit 160' shown in FIG. 6, there is a possibility that one of the bearings supporting the rotational axle 164' rotatably on the case 163 may make contact with the cleaning liquid, and therefore a strong sealing (liquid-resistant) treatment is provided on at least the one of the bearings.

The head cleaning unit 160 shown in FIG. 5 is advantageous in that it has a simple composition and the number of manufacturing steps can be reduced. On the other hand, the head cleaning unit 160' shown in FIG. 6 is advantageous in that the region immersed in the cleaning liquid is uniform, in the upper portion 161B and the lower portion 161C of the inclined surface 161A' of the application roller 161, and therefore excellent stability of application of the cleaning liquid is obtained.

The compositions of the head cleaning units 160 and 160' shown in FIGS. 5 and 6 are examples, and it is also possible to add other functions as appropriate, such as a take-up roller having a function of taking up the cleaning liquid 162 from the case 163, or a function of determining the remaining amount and/or degree of soiling of the cleaning liquid in the case 163 and replenishing and/or replacing the cleaning liquid accordingly.

The cleaning liquid applied to the nozzle surface 72A is removed using a wiping unit 274 (see FIG. 4) when a prescribed time period has elapsed after the application. It is desirable that the wiping unit 274 uses a web made of cloth as a member that wipes the nozzle surface 72A. For the web, it is suitable to use, for example, a cloth material made of polyester or polypropylene fibers and having indentations in the surface.

One embodiment of the composition of the wiping unit 274 includes: a web cartridge, which accommodates the web; an elevator mechanism, which moves the web cartridge upward and downward; and a movement mechanism, which causes the wiping unit 274 to move in the lengthwise direction of the inkjet head 72. Furthermore, one embodiment of the composition of the web cartridge includes: a web feed roll and a web take-up roll, which are accommodated inside a frame; a pressing roller, which presses the web against the nozzle surface 72A of the inkjet head 72; and a pair of drive rollers, which drive and convey the web.

In this composition, the web feed roll is a roll of unused web that is wound in the form of the roll, and the web paid out from the web feed roll is wound up onto the pressing roller, passed through the pair of drive rollers, and taken up onto the web take-up roll.

A suitable tension is applied to the web between the web feed roll and the web take-up roll by the pressing roller and the drive rollers, and the web is pressed against the nozzle surface 72A of the inkjet head 72 in the portion corresponding to the pressing roller.

It is desirable that the feed direction of the web is the opposite direction to the direction of movement of the inkjet head 72 during the wiping and cleaning. By conjointly driving the drive rollers and the shaft of the winding roll in accordance with the movement of the inkjet head 72, a wiping action is carried out by the web while the web is wound up onto the web take-up roll.

The elevator mechanism has an elevator platform, which is capable of moving upward and downward, and the web cartridge is disposed on the elevator platform. By controlling a drive device such as a motor of the elevator mechanism, it is possible to control the contact/non-contact state of the web with respect to the nozzle surface 72A.

Moreover, it is also possible to add functional units required for the cleaning of the nozzle surface 72A, as appropriate, such as a collection unit which collects used cleaning liquid that has been wiped off from the nozzle surface 72A.

In the inkjet recording apparatus 10 shown in FIG. 1, the head cleaning unit 160 shown in FIG. 5 (or 160' shown in FIG. 6) is disposed in the vicinity of the print unit 16 in FIG. 1. The inkjet head 72 is moved to the processing region of the head cleaning unit 160 by means of a head movement mechanism for moving the inkjet head 72 to the processing region of the head cleaning unit 160 (the mechanism including the ball screw 284 in FIG. 4), whereupon the cleaning process of the nozzle surface 72A is carried out.

Figure 7:
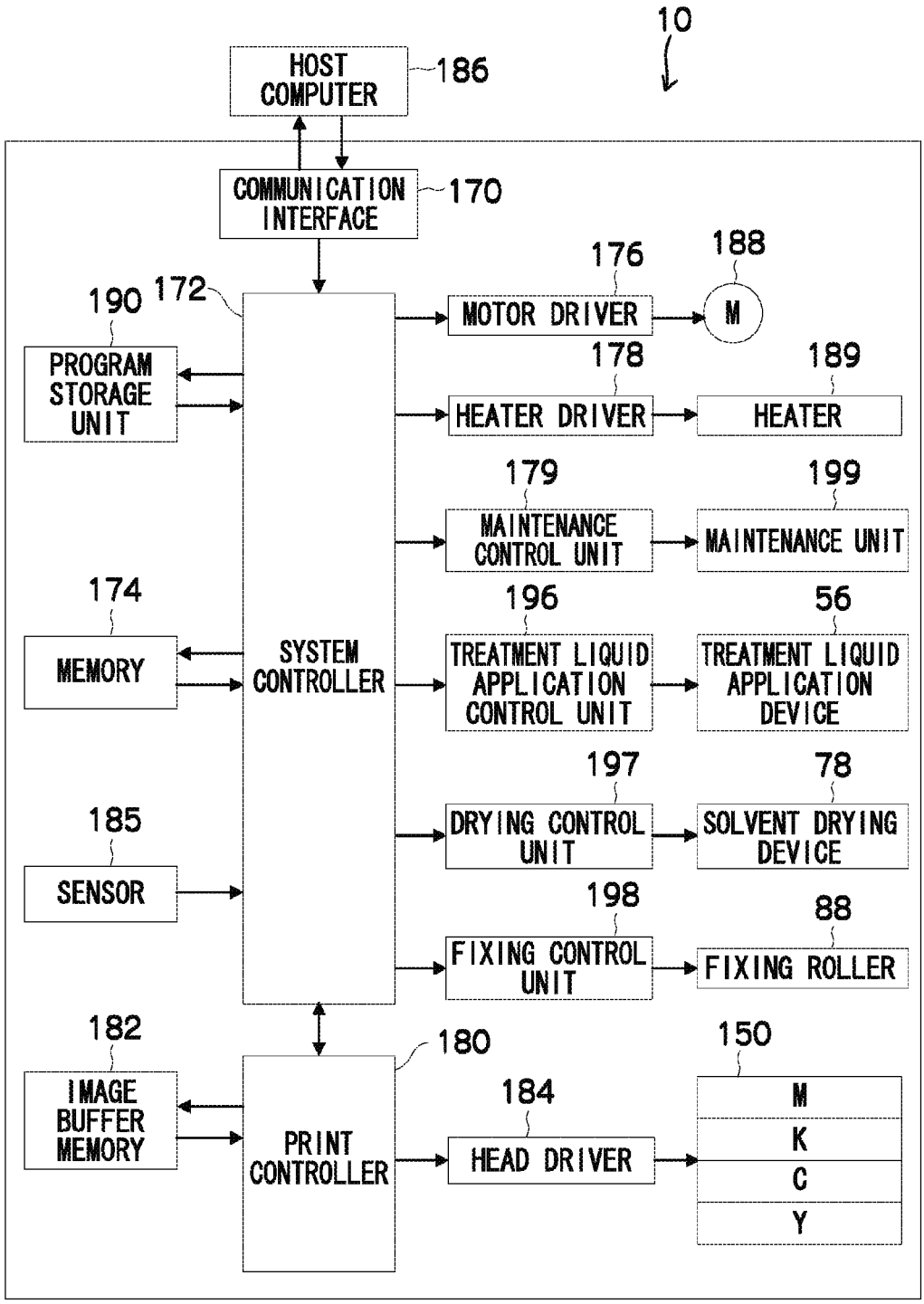
FIG. 7 is a principal block diagram showing the system configuration of the inkjet image recording apparatus in FIG. 1.
Figure 8:
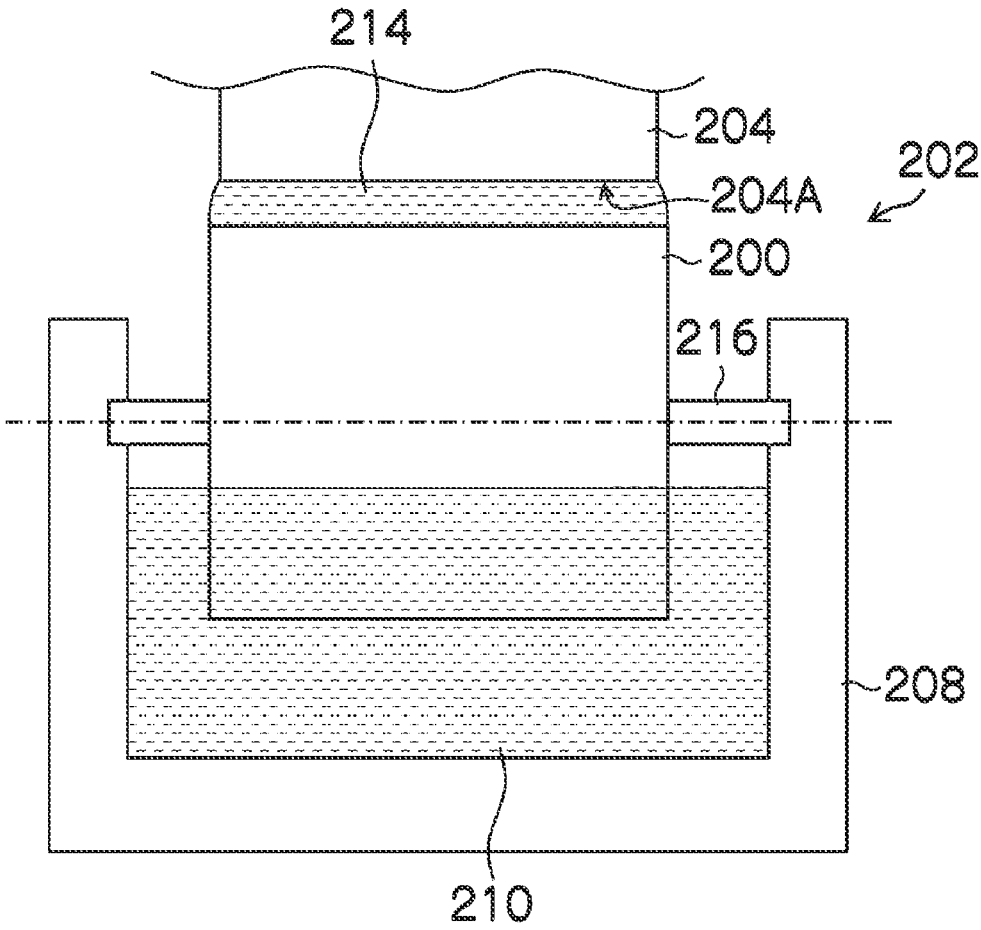
FIG. 8 is a general schematic drawing of a head maintenance unit in the related art.
Figure 9:
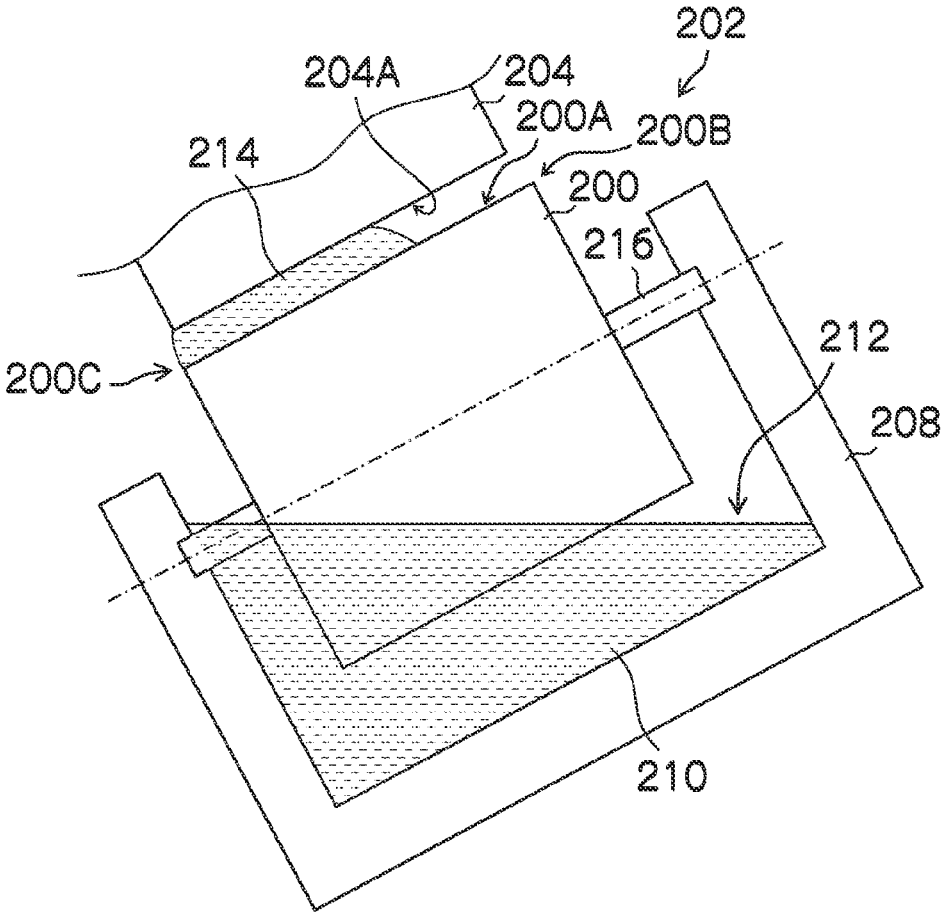
FIG. 9 is a diagram for describing problems associated with the head maintenance unit in the related art.

In the apparatus composition including the plurality of inkjet heads 72M, 72K, 72C and 72Y as shown in FIG. 1, a desirable mode is one in which a plurality of head cleaning units 160 are provided in equal number to the inkjet heads 72M, 72K, 72C and 72Y, and the cleaning process is carried out simultaneously in all of the inkjet heads 72M, 72K, 72C and 72Y. Of course, it is also possible to adopt a composition in which at least one head cleaning unit 160 is provided in smaller number than the inkjet heads 72M, 72K, 72C and 72Y, and the cleaning process is carried out progressively in all of the inkjet heads 72M, 72K, 72C and 72Y while moving the inkjet heads 72M, 72K, 72C and 72Y Description of Control System FIG. 7 is a block diagram of the main portion of a system configuration of the inkjet recording apparatus 10. The inkjet recording apparatus 10 includes a communication interface 170, a system controller 172, a memory 174, the motor driver 176, a heater driver 178, a maintenance control unit 179, a printing control unit 180, an image buffer memory 182, a head driver 184, a sensor 185, a program storage unit 190, a treatment liquid application control unit 196, a drying control unit 197, and a fixing control unit 198.

The communication interface 170 is an interface unit that receives image data sent from a host computer 186. A serial interface such as USB (Universal Serial Bus), IEEE 1394, Ethernet, and a wireless network, or a parallel interface such as Centronix can be applied as the communication interface 170. A buffer memory (not shown) may be installed in the part of the interface to increase the communication speed. The image data sent from the host computer 186 are introduced into the inkjet recording apparatus 10 through the communication interface 170 and temporarily stored in the memory 174.

The memory 174 is a storage device that temporarily stores the images inputted through the communication interface 170 and reads/writes the data via the system controller 172. The memory 174 is not limited to a memory composed of semiconductor elements and may use a magnetic medium such as a hard disk.

The system controller 172 includes a central processing unit (CPU) and a peripheral circuitry thereof, functions as a control device that controls the entire inkjet recording apparatus 10 according to a predetermined program, and also functions as an operational unit that performs various computations. Thus, the system controller 172 controls various units such as the communication interface 170, the memory 174, the motor driver 176, the heater driver 178, the maintenance control unit 179, the treatment liquid application control unit 196, the drying control unit 197 and the fixing control unit 198, performs communication control to with the host computer 180, performs read/write control of the memory 174, and also generates control signals for controlling the various units.

Programs that are executed by the CPU of the system controller 172 and various data necessary for performing the control are stored in the memory 174. The memory 174 may be a read-only storage device or may be a writable storage device such as EEPROM. The memory 174 can be also used as a region for temporary storing image data, a program expansion region, and a computational operation region of the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. The program storage unit 190 may be provided with an external interface, and a memory card or PC card may also be used. Naturally, a plurality of these storage media may also be provided. The program storage unit 190 may also be combined with a storage device for storing operational parameters, and the like (not shown).

The motor driver 176 drives a motor 188 in accordance with commands from the system controller 172. In FIG. 7, the plurality of motors disposed in the respective sections of the inkjet recording apparatus 10 are represented by the reference numeral 188. For example, the motor 188 shown in FIG. 7 includes the motors that drive the paper transfer drum 52, the treatment liquid drum 54, the image formation drum 70, the drying drum 76, the fixing drum 84 and the transfer body 94 shown in FIG. 1, and the motors that drive the intermediate conveyance bodies 32 in the first, second and third intermediate conveyance units 26, 28 and 30.

The heater driver 178 is a driver that drives the heater 189 in accordance with commands from the system controller 172. In FIG. 7, the plurality of heaters disposed in the inkjet recording apparatus 10 are represented by the reference numeral 189. For example, the heater 189 shown in FIG. 7 includes the halogen heaters 80 in the solvent dryer 78 arranged in the drying unit 18 shown in FIG. 1, the halogen heaters in the drying units 38 arranged in the intermediate conveyance bodies 32, and the heaters that heat the surfaces of the drying drum 76 and the fixing drum 84 shown in FIG. 1.

The treatment liquid application control unit 196, the drying control unit 197 and the fixing control unit 198 control the operations of the treatment liquid application device 56, the solvent dryer 78 and the fixing roller 88, respectively, in accordance with commands from the system controller 172.

The printing control unit 180 has a signal processing function for performing a variety of processing and correction operations for generating signals for print control from the image data within the memory 174 according to control of the system controller 172, and supplies the generated printing data (dot data) to the head driver 184. The required signal processing is implemented in the printing control unit 180, and the ejection amount and ejection timing of droplets in the heads 150 are controlled through the head driver 184 based on the image data. As a result, the desired dot size and dot arrangement are realized.

The printing control unit 180 is provided with the image buffer memory 182, and data such as image data or parameters are temporarily stored in the image buffer memory 182 during image data processing in the printing control unit 180. A mode is also possible in which the printing control unit 180 and the system controller 172 are integrated and configured by one processor.

The head driver 184 generates drive signals for driving the piezoelectric elements 158 of the heads 150, on the basis of the dot data supplied from the print controller 180, and drives the piezoelectric elements 158 by applying the generated drive signals to the piezoelectric elements 158. A feedback control system for maintaining constant drive conditions in the recording heads 150 may be included in the head driver 184 shown in FIG. 7.

The sensor 185 represents the sensors disposed in the respective sections of the inkjet recording apparatus 10. For example, the sensor 185 includes the inline sensor 90 shown in FIG. 1, temperature sensors, position determination sensors, and pressure sensors. The output signals of the sensor 185 are sent to the system controller 172, and the system controller 172 controls the respective sections of the inkjet recording apparatus 10 by sending the command signals to the respective sections in accordance with the output signals of the sensor 185.

The maintenance control unit 179 is a processing block that controls the head maintenance unit 199 including the head cleaning unit 160 shown in FIG. 5 or the head cleaning unit 160' shown in FIG. 6, in accordance with a control signal sent from the system controller 172. The maintenance control unit 179 has a function for sending, to the respective units, control signals relating to the implementation of maintenance processing, such as preliminary ejection, sucking, or the like, for expelling degraded ink inside the nozzles of the inkjet head 72 to the exterior.

Although the detailed composition of the maintenance control unit 179 is not depicted, the maintenance control unit 179 includes: a rotation control unit, which controls the rotation mechanism that rotates the application roller 161 (or 161'); a control block which controls the movement mechanism that moves the application roller 161 in the lengthwise direction of the inkjet head 72, the movement mechanism that moves the inkjet head 72 to the position where the head cleaning unit 160 (or 160') is disposed; and a control block which controls the replenishment processing and replacement processing of the cleaning liquid, in accordance with determination signals sent from the sensors which determine the remaining amount and the degree of soiling of the cleaning liquid inside the case 163 (see FIG. 5), and the like.

According to the inkjet recording apparatus 10 having the composition described above, the head cleaning unit 160 for cleaning the nozzle surface 72A of the inkjet head 72, which faces the outer circumferential surface of the print drum 70 and is arranged at an inclination with respect to the horizontal, has the composition where the application roller 161 has the circular conical shape and the inclination of the outer circumferential surface (generator) 161A of the application roller 161 with respect to the horizontal is substantially the same as the inclination of the nozzle surface 72A with respect to the horizontal (i.e., the outer circumferential surface 161A being substantially parallel to the nozzle surface 72A), and it is hence possible to uniformly form the coating layer 165 of the cleaning liquid on the outer circumferential surface 161A of the application roller 161 and to achieve stable application of the cleaning liquid even in the upper portion 161B of the inclined surface 161A of the application roller 161.

Furthermore, in the embodiment shown in FIG. 6, the rotational axle 164' of the application roller 161' is inclined with respect to the horizontal in such a manner that the inclination angle obtained by adding together the inclination angle $\beta$ of the rotational axle 164' with respect to the horizontal and the inclination angle $\gamma$ of the outer circumferential surface 161A' of the application roller 161' with respect to the rotational axle 164' is substantially the same as the inclination angle $\alpha$ of the nozzle surface 72A with respect to the horizontal, whereby it is possible to achieve more stable application of the cleaning liquid.

In the present embodiments, the mode has been described in which the head cleaning unit 160 (160') is appended to the inkjet recording apparatus 10; however, it is also possible to compose a maintenance apparatus for the inkjet head by separating the head cleaning unit 160 to from the inkjet recording apparatus 10.

Furthermore, in the present embodiments, the inkjet recording apparatus has been described which records a color image by ejecting and depositing color inks onto a recording medium as one example of an image forming apparatus; however, the present invention can also be applied to an image forming apparatus which forms a prescribed pattern shape on a substrate by means of a resin liquid, or the like, in order, for instance, to form a mask pattern or to print wiring of a printed wiring board.

APPENDIX

As has become evident from the detailed description of the embodiments given above, the present specification includes disclosure of various technical ideas below.

It is preferable that a recording head cleaning apparatus which cleans a nozzle surface of a recording head that is disposed at an inclination with respect to horizontal, the apparatus comprises: an application roller having a substantially conical shape of which a circumferential surface holds cleaning liquid and has an inclination corresponding to the inclination of the nozzle surface, a rotational axis of the application roller being an axis of the substantially conical shape; and a rotating device which rotates the application roller on the rotational axis to apply the cleaning liquid to the nozzle surface while not making the application roller in contact with the nozzle surface.

According to this mode, when cleaning the nozzle surface of the recording head that is arranged at the inclination with respect to the horizontal, the substantially conical application roller having the circumferential surface with the inclination corresponding to the inclination of the nozzle surface with respect to the horizontal is used, and therefore the cleaning liquid assumes a uniform shape from the upper portion to the lower portion of the inclined circumferential surface of the application roller, and stable application of the cleaning liquid can be achieved from the upper portion to the lower portion of the inclined nozzle surface.

A "substantially conical" shape is a concept which includes a truncated conical shape (a shape where the apex of cone is cut off by a plane), and the projected shape of the side face may be a triangular or a trapezoid, for example.

One mode of applying the cleaning liquid to the nozzle surface in a non-contact fashion is a mode where a coating layer of the cleaning liquid is formed on the circumferential surface of the application roller while rotating the application roller and the coating layer is to brought into contact with the nozzle surface.

Preferably, the inclination of the circumferential surface of the application roller with respect to the horizontal is substantially equal to the inclination of the nozzle surface with respect to the horizontal; and the rotational axis of the application roller is disposed substantially horizontal.

According to this mode, it is possible to apply cleaning liquid uniformly to the nozzle surface.

Preferably, the rotational axis of the application roller is disposed at an inclination with respect to the horizontal; and a sum of the inclination of the rotational axis with respect to the horizontal and an inclination of the circumferential surface of the application roller with respect to the rotational axis is substantially equal to the inclination of the nozzle surface with respect to the horizontal.

In this mode, the relationship $\alpha=\beta+\gamma$ may be satisfied where $\alpha$ is the inclination angle of the nozzle surface with respect to the horizontal, $\beta$ is the inclination angle of the rotational axis of the application roller with respect to the horizontal, and $\gamma$ is the inclination angle of the circumferential surface of the application roller with respect to the rotational axis.

Preferably, the apparatus further comprises: a cleaning liquid accommodating device which accommodates the cleaning liquid and rotatably supports the rotational axis of the application roller, wherein the rotational axis is inclined with respect to the horizontal by inclining the cleaning liquid accommodating device with respect to the horizontal.

In this mode, desirably, the rotational axis of the application roller is supported by the cleaning liquid accommodating device, in such a manner that the circumferential surface of the immersed portion of the application roller immersed in the cleaning liquid is substantially parallel to the surface of the cleaning liquid accommodated in the cleaning liquid accommodating device.

Preferably, the inclination of the rotational axis of the application roller with respect to the horizontal is substantially equal to the inclination of the circumferential surface of the application roller with respect to the rotational axis.

According to this mode, the immersed portion of the application roller immersed in the cleaning liquid in the cleaning liquid accommodating device is uniform, and therefore a uniform coating layer can be formed on the circumferential surface of the application roller.

Preferably, the application roller is supported in such a manner that a portion thereof to is immersed in the cleaning liquid accommodated in the cleaning liquid accommodating device.

According to this mode, by achieving a function of taking up the cleaning liquid and a function of applying the cleaning liquid in one roller, the structure is simplified and improvement in the ease of assembly can be expected.

Preferably, the apparatus further comprises a movement device which causes the recording head and the application roller to move relatively to each other in a lengthwise direction of the recording head.

According to this mode, the cleaning liquid can be applied to the whole of the lengthwise direction of the recording head, without providing a plurality of application rollers in the lengthwise direction of the recording head (nozzle surface).

It is also preferable that an image recording apparatus comprises: a recording medium conveyance device which has a cylindrical shape and holds and conveys a recording medium on a circumferential surface of the recording medium conveyance device in a prescribed conveyance direction; a recording head having a nozzle surface in which nozzles ejecting liquid to record an image on the recording medium are arranged, the nozzle surface being disposed to face the circumferential surface of the recording medium conveyance device at an inclination with respect to horizontal; and a recording head cleaning unit which includes: an application roller having a substantially conical shape of which a circumferential surface holds cleaning liquid and has an inclination corresponding to the inclination of the nozzle surface, a rotational axis of the application roller being an axis of the substantially conical shape; and a rotating device which rotates the application roller on the rotational axis to apply the cleaning liquid to the nozzle surface while not making the application roller in contact with the nozzle surface.

The image recording apparatus includes an inkjet recording apparatus which forms a desired color image on a recording medium by ejecting color inks from the nozzles.

Preferably, the apparatus further comprises a movement device which causes the recording head and the application roller to move relatively to each other in a lengthwise direction of the recording head perpendicular to the conveyance direction of the recording medium.

This mode is suitable in a case where a full line type of head having a length corresponding to the whole width of the recording medium is provided.

It is also preferable that a method of cleaning a nozzle surface of a recording head that is disposed at an inclination with respect to horizontal, the method comprises the steps of: rotating an application roller having a substantially conical shape of which a circumferential surface holds cleaning liquid and has an inclination corresponding to the inclination of the nozzle surface, on a rotational axis of the application roller being an axis of the substantially conical shape; and applying the cleaning liquid to the nozzle surface while not making the application roller in contact with the nozzle surface.

In this mode, it is preferable to dispose the rotational axis of the application roller at an inclination with respect to the horizontal so that a sum of the inclination of the rotational axis with respect to the horizontal and an inclination of the circumferential surface of the application roller with respect to the rotational axis is substantially equal to the inclination of the nozzle surface with respect to the horizontal.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording head cleaning apparatus which cleans a nozzle surface of a recording head that is disposed at an inclination with respect to horizontal, the apparatus comprising:

an application roller having a substantially conical shape of which a circumferential surface holds cleaning liquid and has an inclination corresponding to the inclination of the nozzle surface, a rotational axis of the application roller being an axis pertaining to the substantially conical shape; and a rotating device which rotates the application roller on the rotational axis to apply the cleaning liquid to the nozzle surface while not making the application roller in contact with the nozzle surface, wherein the rotational axis of the application roller is provided as being not parallel to the nozzle surface of the recording head.

2. The apparatus as defined in claim 1, wherein:

the inclination of the circumferential surface of the application roller with respect to the horizontal is substantially equal to the inclination of the nozzle surface with respect to the horizontal; and the rotational axis of the application roller is disposed substantially horizontal.

3. A recording head cleaning apparatus which cleans a nozzle surface of a recording head that is disposed at an inclination with respect to horizontal, the apparatus comprising:

an application roller having a substantially conical shape of which a circumferential surface holds cleaning liquid and has an inclination corresponding to the inclination of the nozzle surface, a rotational axis of the application roller being an axis pertaining to the substantially conical shape; and a rotating device which rotates the application roller on the rotational axis to apply the cleaning liquid to the nozzle surface while not making the application roller in contact with the nozzle surface, wherein:

the rotational axis of the application roller is disposed at an inclination with respect to the horizontal; and a sum of the inclination of the rotational axis with respect to the horizontal and an inclination of the circumferential surface of the application roller with respect to the rotational axis is substantially equal to the inclination of the nozzle surface with respect to the horizontal.

4. The apparatus as defined in claim 3, wherein the inclination of the rotational axis of the application roller with respect to the horizontal is substantially equal to the inclination of the circumferential surface of the application roller with respect to the rotational axis.

5. The apparatus as defined in claim 3, further comprising:

a cleaning liquid accommodating device which accommodates the cleaning liquid and rotatably supports the rotational axis of the application roller, wherein the rotational axis is inclined with respect to the horizontal by inclining the cleaning liquid accommodating device with respect to the horizontal.

6. The apparatus as defined in claim 5, wherein the application roller is supported in such a manner that a portion thereof is immersed in the cleaning liquid accommodated in the cleaning liquid accommodating device.

7. The apparatus as defined in claim 1, further comprising a movement device which causes the recording head and the application roller to move relatively to each other in a lengthwise direction of the recording head.

8. An image recording apparatus, comprising:

a recording medium conveyance device which has a cylindrical shape and holds and conveys a recording medium on a circumferential surface of the recording medium conveyance device in a prescribed conveyance direction;

a recording head having a nozzle surface in which nozzles ejecting liquid to record an image on the recording medium are arranged, the nozzle surface being disposed to face the circumferential surface of the recording medium conveyance device at an inclination with respect to horizontal; and a recording head cleaning unit which includes: an application roller having a substantially conical shape of which a circumferential surface holds cleaning liquid and has an inclination corresponding to the inclination of the nozzle surface, a rotational axis of the application roller being an axis pertaining to the substantially conical shape; and a rotating device which rotates the application roller on the rotational axis to apply the cleaning liquid to the nozzle surface while not making the application roller in contact with the nozzle surface, wherein the rotational axis of the application roller is provided as being not parallel to the nozzle surface of the recording head.

9. The apparatus as defined in claim 8, wherein:

the inclination of the circumferential surface of the application roller with respect to the horizontal is substantially equal to the inclination of the nozzle surface with respect to the horizontal; and the rotational axis of the application roller is disposed substantially horizontal.

10. An image recording apparatus, comprising:

a recording medium conveyance device which has a cylindrical shape and holds and conveys a recording medium on a circumferential surface of the recording medium conveyance device in a prescribed conveyance direction;

a recording head having a nozzle surface in which nozzles ejecting liquid to record an image on the recording medium are arranged, the nozzle surface being disposed to face the circumferential surface of the recording medium conveyance device at an inclination with respect to horizontal; and a recording head cleaning unit which includes: an application roller having a substantially conical shape of which a circumferential surface holds cleaning liquid and has an inclination corresponding to the inclination of the nozzle surface, a rotational axis of the application roller being an axis pertaining to the substantially conical shape; and a rotating device which rotates the application roller on the rotational axis to apply the cleaning liquid to the nozzle surface while not making the application roller in contact with the nozzle surface, wherein:

the rotational axis of the application roller is disposed at an inclination with respect to the horizontal; and a sum of the inclination of the rotational axis with respect to the horizontal and an inclination of the circumferential surface of the application roller with respect to the rotational axis is substantially equal to the inclination of the nozzle surface with respect to the horizontal.

11. The apparatus as defined in claim 10, wherein the inclination of the rotational axis of the application roller with respect to the horizontal is substantially equal to the inclination of the circumferential surface of the application roller with respect to the rotational axis.

12. The apparatus as defined in claim 10, further comprising:

a cleaning liquid accommodating device which accommodates the cleaning liquid and rotatably supports the rotational axis of the application roller, wherein the rotational axis is inclined with respect to the horizontal by inclining the cleaning liquid accommodating device with respect to the horizontal.

13. The apparatus as defined in claim 12, wherein the application roller is supported in such a manner that a portion thereof is immersed in the cleaning liquid accommodated in the cleaning liquid accommodating device.

14. The apparatus as defined in claim 8, further comprising a movement device which causes the recording head and the application roller to move relatively to each other in a lengthwise direction of the recording head perpendicular to the conveyance direction of the recording medium.

15. A method of cleaning a nozzle surface of a recording head that is disposed at an inclination with respect to horizontal, the method comprising the steps of:

rotating an application roller having a substantially conical shape of which a circumferential surface holds cleaning liquid and has an inclination corresponding to the inclination of the nozzle surface, on a rotational axis of the application roller being an axis pertaining to the substantially conical shape; and applying the cleaning liquid to the nozzle surface while not making the application roller in contact with the nozzle surface, wherein the rotational axis of the application roller is provided as being not parallel to the nozzle surface of the recording head.

16. The method as defined in claim 15, wherein:

the inclination of the circumferential surface of the application roller with respect to the horizontal is substantially equal to the inclination of the nozzle surface with respect to the horizontal; and the rotational axis of the application roller is disposed substantially horizontal.

17. A method of cleaning a nozzle surface of a recording head that is disposed at an inclination with respect to horizontal, the method comprising the steps of:

rotating an application roller having a substantially conical shape of which a circumferential surface holds cleaning liquid and has an inclination corresponding to the inclination of the nozzle surface, on a rotational axis of the application roller being an axis pertaining to the substantially conical shape; and applying the cleaning liquid to the nozzle surface while not making the application roller in contact with the nozzle surface, wherein:

the rotational axis of the application roller is disposed at an inclination with respect to the horizontal; and a sum of the inclination of the rotational axis with respect to the horizontal and an inclination of the circumferential surface of the application roller with respect to the rotational axis is substantially equal to the inclination of the nozzle surface with respect to the horizontal.

18. The method as defined in claim 17, wherein the inclination of the rotational axis of the application roller with respect to the horizontal is substantially equal to the inclination of the circumferential surface of the application roller with respect to the rotational axis.

19. The method as defined in claim 17, further comprising the steps of:

accommodating the cleaning liquid in a cleaning liquid accommodating device which rotatably supports the rotational axis of the application roller; and inclining the cleaning liquid accommodating device with respect to the horizontal to incline the rotational axis with respect to the horizontal.

20. The method as defined in claim 15, further comprising the step of causing the recording head and the application roller to move relatively to each other in a lengthwise direction of the recording head.

* * * * *